US006968641B2

(12) United States Patent
Pollack

(10) Patent No.: US 6,968,641 B2
(45) Date of Patent: Nov. 29, 2005

(54) SNAP-TOGETHER POSTER FRAME SYSTEM

(76) Inventor: Ronald M. Pollack, 20 Continental Ave., Forest Hills, NY (US) 11375

( * ) Notice: Subject to any disclaimer, the term of this patent is extended or adjusted under 35 U.S.C. 154(b) by 4 days.

(21) Appl. No.: 10/731,194

(22) Filed: Dec. 8, 2003

(65) Prior Publication Data

US 2004/0111943 A1 Jun. 17, 2004

Related U.S. Application Data

(63) Continuation of application No. 09/479,823, filed on Jan. 7, 2000, now abandoned.

(60) Provisional application No. 60/115,209, filed on Jan. 8, 1999.

(51) Int. Cl.[7] ..... A47G 1/06

(52) U.S. Cl. ..... 40/733; 40/740; 40/783; 40/792

(58) Field of Search ..... 40/605, 606.16, 40/606.17, 611.01, 611.05, 729, 730, 733, 40/740, 783, 791, 792, 793, 794, 782, 790, 40/658; 403/401, 403, 402; 24/563

(56) References Cited

U.S. PATENT DOCUMENTS

| | | | | | |
|---|---|---|---|---|---|
| 3,060,606 | A | * | 10/1962 | Peach | 40/791 |
| 3,132,432 | A | * | 5/1964 | Yee | 40/730 |
| 3,835,562 | A | * | 9/1974 | Thistlethwaite et al. | 40/783 |
| 4,523,400 | A | * | 6/1985 | Seely | 40/791 |
| 4,669,209 | A | * | 6/1987 | Pollack | 40/793 |
| RE32,820 | E | * | 1/1989 | Pollack | 174/68.3 |
| 4,986,013 | A | * | 1/1991 | Pollack | 40/783 |
| 5,040,318 | A | * | 8/1991 | Ryan | 40/396 |
| 5,398,376 | A | * | 3/1995 | Pollack | 16/225 |
| 5,402,976 | A | * | 4/1995 | Pollack | 248/300 |
| 6,161,320 | A | * | 12/2000 | Peterson | 40/605 |

* cited by examiner

*Primary Examiner*—Brian K. Green
(74) *Attorney, Agent, or Firm*—Galgano & Burke LLP

(57) ABSTRACT

A snap-together poster frame includes a plurality of edge supports, each comprising a plurality of segments having a slotted, channel-shaped cross-sectional profile to define a single opening having an unobstructed mouth for receiving an edge of a poster board. The segments include a top wall, a bottom wall and a sidewall joining the top and bottom walls. The edge support is resilient and the sidewall includes a generally L-shaped instep by which it is joined to the bottom wall having three flex points which allows the opening to adjust to the width of the posterboard inserted therein, thereby retaining the edge of the poster board via an interference fit.

11 Claims, 5 Drawing Sheets

SNAP-TOGETHER POSTER FRAME SYSTEM

CROSS-REFERENCE TO PROVISIONAL PATENT APPLICATION

This is a continuation of U.S. Ser. No. 09/479,823 filed on Jan. 7, 2000 now abandoned.

Domestic priority is hereby claimed, pursuant to 35 U.S.C. §119(e), from U.S. Provisional Patent Application Ser. No. 60/115,209, filed Jan. 8, 1999, the entire disclosure of which is hereby incorporated by reference.

BACKGROUND OF THE INVENTION

1. Technical Field of the Invention

The present invention relates, generally, to a snap-together poster frame system.

More particularly, the present invention relates to a snap-together poster frame system, of a single profile, which can easily and firmly accept or retain several thicknesses of board stock, reduce costs and inventory concern. The poster frame system of the invention which includes several types of flexible frame sections, which would automatically flex out and up upon insertion of various thicknesses of board inserted into the open gap of the profile.

The poster board for which the frame is intended would not have to extend to the rear end of the profile of the frame due to a built-in step on the profile, which limits loss of surface area of the board being framed.

2. Description of the Prior Art

The prior art includes various picture framing systems, which have generally fixed open gaps to accept board material of the same general thickness. Several of such prior art framing systems have lining hinges which are joined together.

Various poster framing systems known to the relevant art are disclosed by the inventor's prior patents, e.g., U.S. Pat. No. 4,669,209, issued Jun. 2, 1987; U.S. Pat. No. 4,986,013, issued Jan. 22, 1991; U.S. Pat. No. 5,398,376, issued Mar. 21, 1995; and, U.S. Pat. No. 5,617,660, issued Apr. 8, 1997.

SUMMARY OF THE INVENTION

It is, therefore, an object of the present invention to provide a snap-together poster frame system, which includes profile segments for which a single profile could easily and firmly accept and retain several thickness of board stock.

It is a further object of the present invention to provide a snap-together poster frame system, which provides profile segments for which a single profile would be sufficient for various thicknesses of poster board, thereby reducing the costs, and inventory concerns, otherwise associated with having to stock poster boards of a wide-range of thicknesses.

It is, yet, a further object of the present invention to provide a snap-together poster frame system which would include a plurality of flexible connectors that would allow frames to be shipped flat, and to then be joined, assembled, or completed, on site by simply snapping these flexible connectors over the frame members as, and where, required.

The foregoing and related objects are achieved by the use of a plurality of frame sections and flexible connectors, for which the frame sections are, preferably, made of a flexible, resilient plastic material having a slotted substantially channel-shaped cross-sectional profile. These frame, or profile, sections would have, at least, three flex points at the rear end of the profile, i.e., the rear end being defined as the portion of the profile opposite, or farthest from, the gap, or opening, through which an edge of poster board would be inserted. The upper end of the forward gap would, preferably, have a soft-turned or beaded edge. The base of the frame section is, preferably, but not necessarily, flat. Along the lower-half of the rear wall of the frame section is a "step," which acts as a "stop" to limit the loss of surface area of the board being framed.

The present invention would further include snap-on corner sections, which would also be made of a resilient material, preferably, a resilient plastic material, which would have a substantially arcuate shape of slightly greater dimension, so as to be fitted over the edges of various frame sections, positioned perpendicularly relative to one another.

Certain of the foregoing and related objects are achieved by a snap-together poster frame, comprising a plurality of edge supports, each comprising a plurality of segments having a slotted, channel-shaped cross-sectional profile to define a single opening for receiving an edge of a poster board. The segments comprise a top wall, a bottom wall and a sidewall joining said top and bottom walls, said edge supports being resilient and said sidewall including a generally L-shaped instep by which it is joined to said bottom wall having three flex points which allows said opening to adjust to the width of the posterboard inserted therein, thereby retaining the edge of the poster board via an interference fit. The top wall and said bottom wall each having a front and rear end and said sidewall joins said rear ends of said front and bottom walls. The front ends define an unobstructed mouth of said single opening between them and said front end of said top wall and said bottom wall cooperate to resiliently grasp a poster board inserted therebetween. The sidewall comprise three generally linear segments including a first segment, a second segment and a third segment, said first segment being disposed generally perpendicularly relative to said top wall and said first segment having a first end coupled to said rear end of said top wall and a second end coupled to a first end of said second segment and said third segment disposed generally perpendicularly to said second segment and said bottom wall, said third segment having a first end coupled to a second end of said second segment and a second end coupled to said rear end of said bottom wall.

In a preferred embodiment, a snap together poster frame system is provided which includes at least two of the aforesaid snap-together poster frames and at least one end connection for connecting the ends of one of said snap-together poster frames to the ends of another of said snap-together poster frames.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1A:
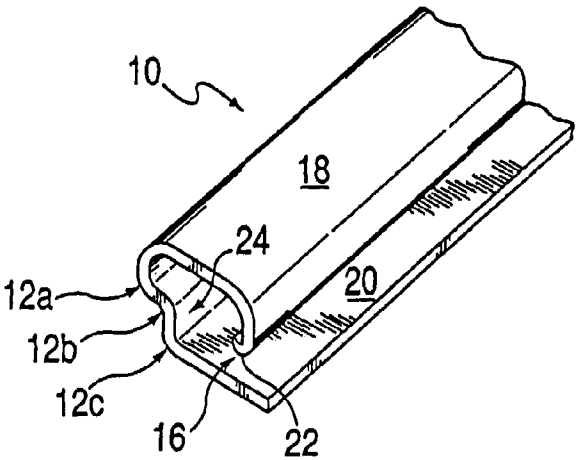
FIG. 1A is a partial, cross-sectional perspective view of segment of a first preferred embodiment of a substantially E-shaped frame, or profile, section having three flex points at the rear end of the profile.
Figure 1B:
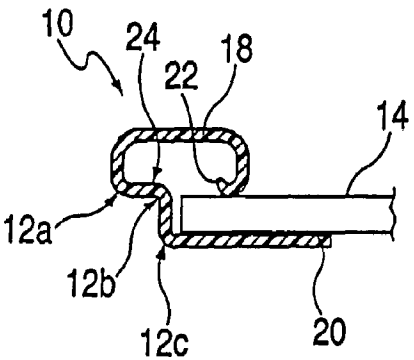
FIG. 1B is a cross-sectional, elevational view of the substantially E-shaped profile section of FIG. 1A retaining an edge of a poster board within said profile section.

Turning now, in detail, to an analysis of the accompanying drawing figures, FIG. 1A is a partial, cross-sectional perspective view of segment of a first preferred embodiment of a slotted, channel-shaped frame 10 or profile section 10 made of a resilient material, preferably plastic, e.g., polyvinylchloride, having three flex points 12*a*, 12*b*, 12*c* at the rear end of the profile. Frame segment 10 is designed to retain the border of a piece of poster board 14, as illustrated in FIG. 1B, through slot or gap 16. The dome-shaped upper portion 18 of frame segment 10 overhangs the base 20 and has a beaded, or rounded, forward edge 22, which rests against the surface of poster board 14. The rear end of upper portions merges with an inverted substantially L-shaped step 24 which defines three flex points 12*a*, 12*b* and 12*c*.

Flex points 12*a*, 12*b*, 12*c* and upper portion 18 will readily flex upward upon insertion of various thicknesses of poster board 14 into gap 16. Because of step 24, poster board 14 will not have to extend the entire depth of frame segment 10 and, thus, the loss of surface area engaged by the frame of the invention is less than with comparable systems currently known to the prior art, which typically have a fixed gap or do not employ a step having triple flex points for retaining the poster board with a minimal loss of surface area.

Frame segment 10, of a suitable length in comparison to the poster board being framed, is constructed to retain one side of the poster board 14. Similar frame segments are to be utilized preferably along the perimeter of the entire poster board.

Figure 2A:
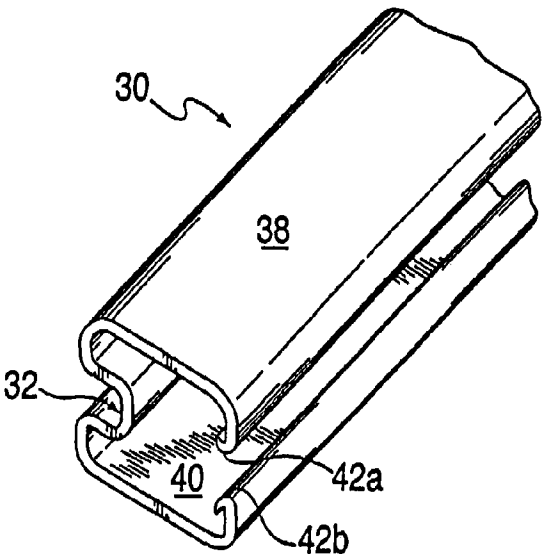
FIG. 2A is a partial, cross-sectional perspective view of an alternatively preferred embodiment of a segment of a substantially E-shaped frame, or profile, section having a forward ridge at the rear end of the profile.

FIG. 2A is a partial, cross-sectional perspective view of an alternatively preferred embodiment of a segment of a generally E-shaped frame 30 or profile section 30 having a forward ridge, or step, 32 at the rear end of the frame segment. This embodiment of the invention includes a dome-shaped overhang 38, which is analogous to that of overhang 18 of FIG. 1A, and includes a base 40, which is constructed as a mirror-image of overhang 38. Both overhang 38 and base 40 have a forward edge 42*a*, 42*b*, which is rounded. Because of the symmetrical construction of both overhang 38 and base 40, forward step 32 is centrally located along the rear portion of frame segment 30.

Figure 2B:
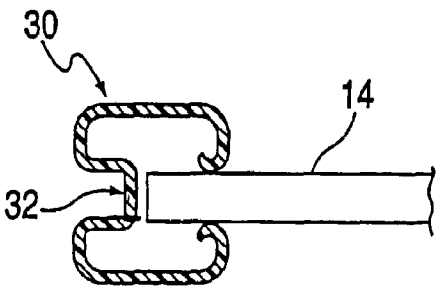
FIG. 2B is a cross-sectional, elevational view of the substantially E-shaped profile section of FIG. 2A retaining an edge of a poster board within said profile section.

FIG. 2B is a cross-sectional, elevational view of the frame segment 30 retaining an edge of a poster board 14 within said frame segment. Because of step 32, poster board 14 will not have to extend the entire depth of frame segment 30 and, thus, the loss of surface area engaged by the frame of the invention is minimized. Like frame segment 10, frame segment 30 is intended to extend substantially along the length of one side of poster board 14, with an additional segment preferably being provided for each additional side of the poster board.

Figure 3:
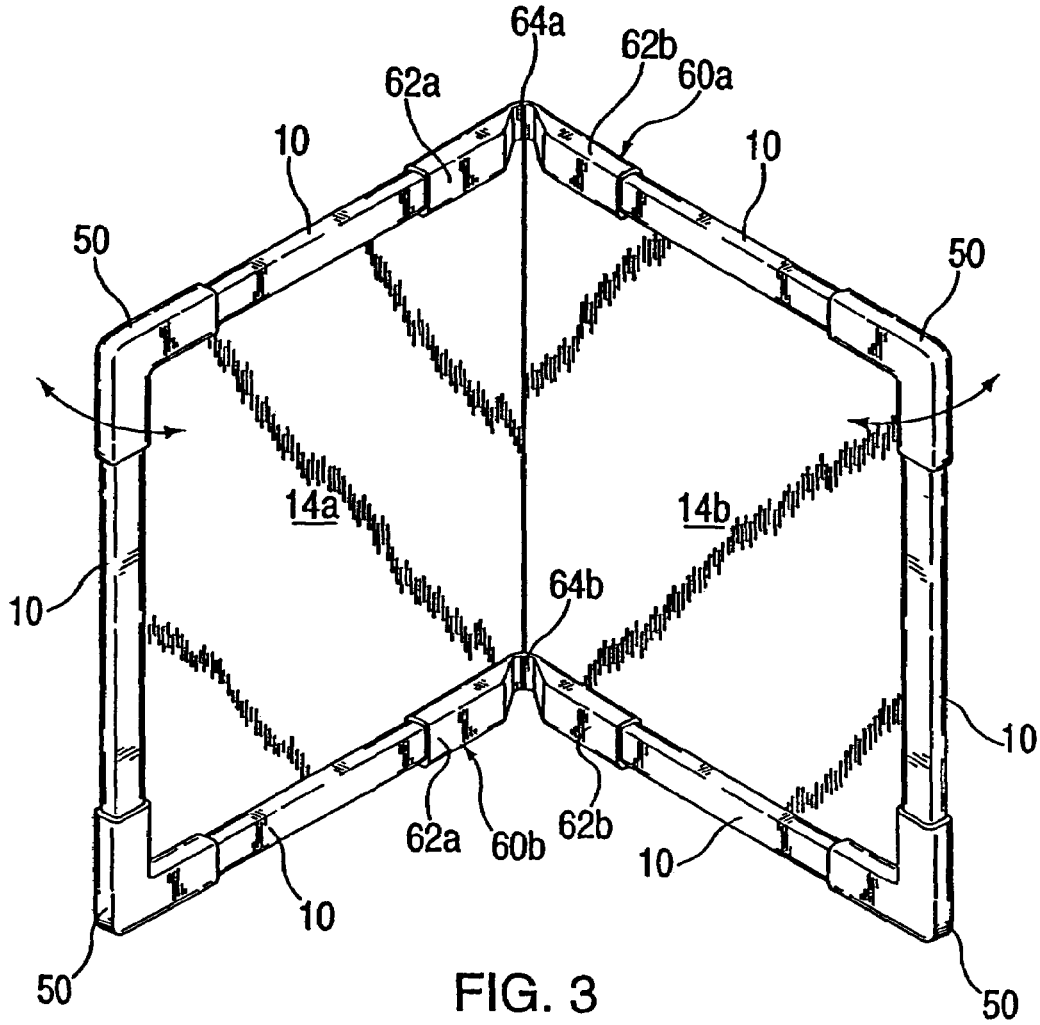
FIG. 3 is a front perspective view of poster board, framed with the snap-together poster frame system of the present invention and provided with end connectors for connecting adjacent pieces of poster board, so that such adjacent features can be flexed relative to one another.

FIG. 3 is a front perspective view of poster boards 14*a*, 14*b*, framed with the snap-together poster frame system of the present invention. Frame segments 10 (or 30) are shown as being engaged with the various side of poster boards 14*a*, 14*b* in the manner illustrated in FIG. 1B or FIG. 2B, depending upon the embodiment of frame segment utilized.

Once frame segments 10 (or 30) are affixed with the sides of poster board 14*a*, 14*b*, the corners of the poster board are provided with corner connectors 50 for completing the entire perimeter of the frame. Corner connectors 50 should not simply round the corner of the poster board, but should also extend a sufficient distance along the side of the frame so that it overlaps and covers the ends of frame segments 10 (or 30.) These corner connectors 50 are provided with a similar shape, though slightly larger dimension than the frame segments, so that the corner connectors may snap over, and become removably affixed to, the corners of respective frame segments.

Figure 5:
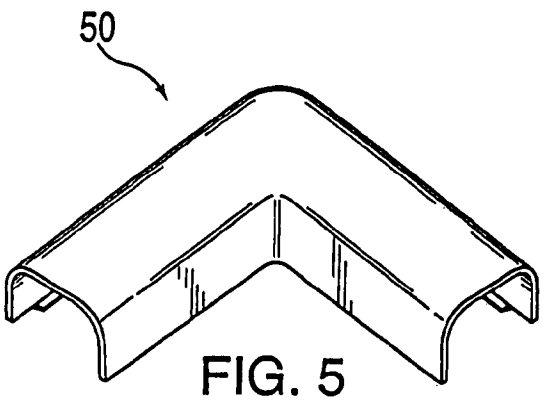
FIG. 5 is a top perspective view of a corner piece connector, which is shown at the outer four corners of the poster frame illustrated in FIG. 3.

The precise construction of corner connectors 50, which is separately illustrated in FIG. 5 of the instant disclosure, is similar to that disclosed in the inventor's prior patent, U.S. Pat. No. Re. 32,820, issued Jan. 3, 1989, in which FIGS. 6 and 7 of said patent show such corner connectors, with the textual disclosure thereof describing the same. The relevant portions of U.S. Pat. No. Re. 32,820, which disclose the construction and use of such corner connectors, shall be deemed to be incorporated by reference into this disclosure.

The corner connector 50 of FIG. 5 has a non-linear, planar configuration corresponding to the corner created by two frame segments 10 (or 30). Thus, as clearly seen in FIG. 3, when corner connector 50 is in place and engaging perpendicular frame segments 10 (or 30), an aesthetically pleasing and continuous picture frame is created along the perimeter of poster board 14.

Figure 6:
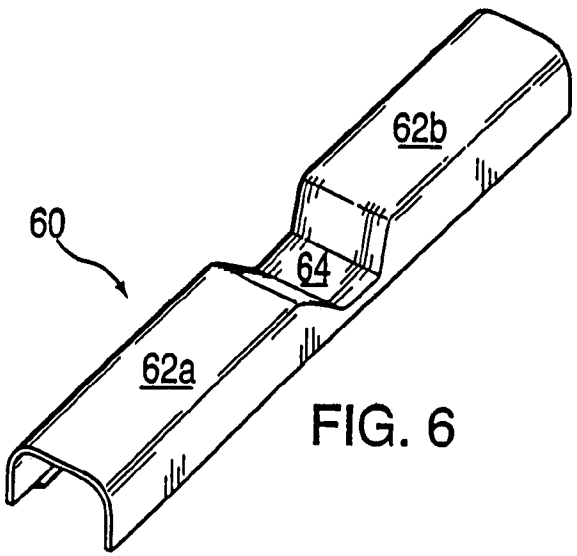
FIG. 6 is a top perspective view of an end connector, two of which are illustrated connecting two adjacent pieces of poster board in FIG. 3.

In FIG. 3, poster board 14*a* is connected to poster board 14*b* via end connectors 60*a*, 60*b*. FIG. 6, in fact, provides a top perspective view of end connector 60, which is comprised of segments 62*a*, 62*b* which, like corner connector 50, have a non-linear, planar configuration corresponding to the outer surface shape of frame segments 10 (or 30). Segments

62*a*, 62*b* of each end connector 60 are, themselves, attached to one another via a flexible, durable web of plastic material 64*a*, 64*b* preferably, polypropylene, so as to serve, in effect, like a living hinge. With end connectors 60*a*, 60*b*, one is able to provide a picture frame for two sections of poster board 14*a*, 14*b*, which may be flexed relative to one another, in an infinite number of arrangements.

Figure 4A:
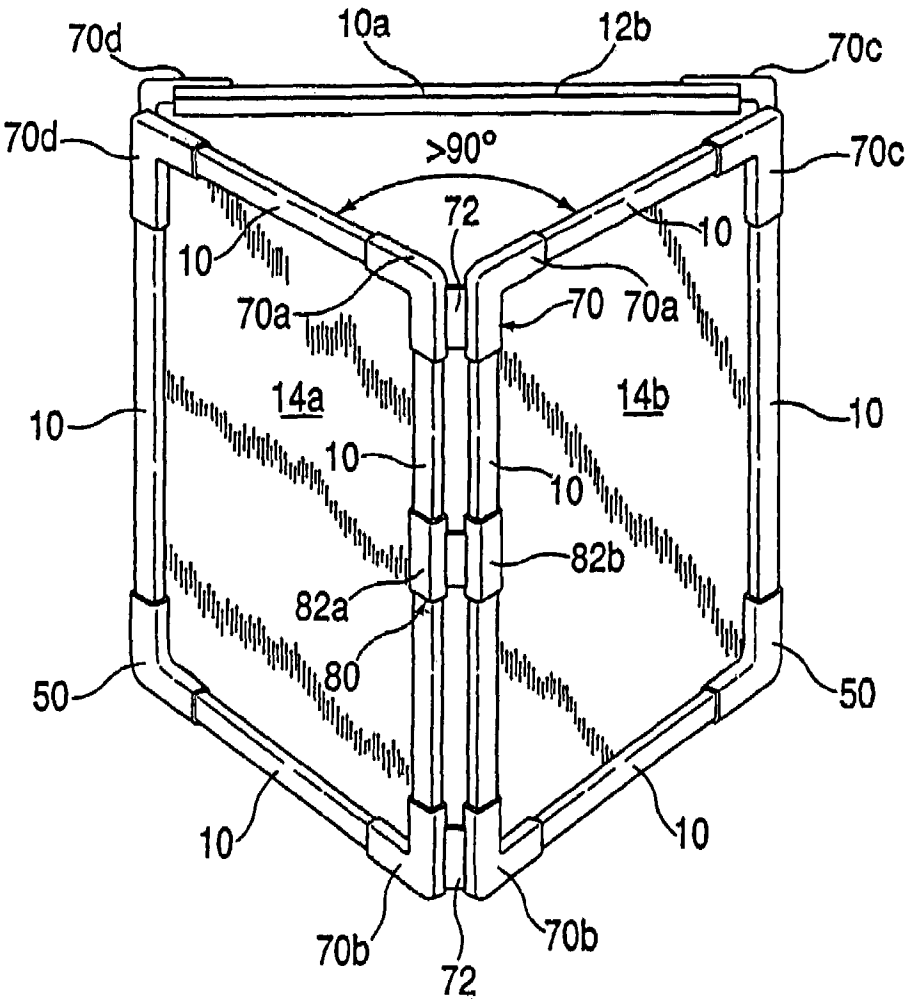
FIG. 4A is a perspective view of two pieces of poster board framed with the snap-together poster frame system of the present invention and provided with hinge connectors, which allow the two pieces of poster board so framed to be held at fixed angles adjacent to one another.
Figure 7:
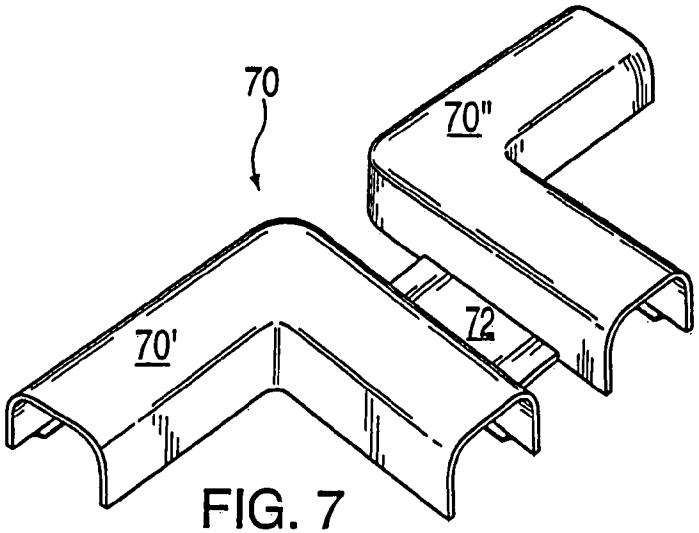
FIG. 7 is a top perspective view of a hinge connector of the type used in the embodiment of the invention illustrated in FIG. 4; and, FIG. 8A is a top perspective view of a joiner hinge, which is useful for joining the substantially E-shaped profile sections of two pieces of poster board framed with the snap-together poster board system of the present invention.

FIG. 4A is a perspective view of two pieces of poster board 14*a*, 14*b* framed with the snap-together poster frame system of the present invention and provided with hinge connectors 70, which allow the two pieces of poster board so framed to be held at fixed angles adjacent to one another. FIG. 7 separately provides a top perspective view of hinge connector 70 of the type used in the embodiment of the invention illustrated in FIG. 4A.

Referring to FIG. 7, each hinge connector 70 is comprised of two parts, 70', 70", which are analogous to corner connectors 50, illustrated in FIGS. 3 and 6. Each part 70', 70" of hinge connector 70 is attached to one another via a flexible, durable web of plastic material 72, preferably, polypropylene. Attachment 72 is analogous to attachment 64 used in end connectors 60, also as illustrated in FIGS. 3 and 6.

Referring back to FIG. 4A, two pieces of poster board 14*a*, 14*b* are shown as each being totally framed, i.e., the perimeters of each completely framed by either segments 10, corner connectors 50, or hinge connectors 70; the latter of which are able to replace corner connectors 50 for those corners of poster board 14*a*, 14*b* that are intended to be flexibly hinged to another piece of poster board.

Figure 4B:
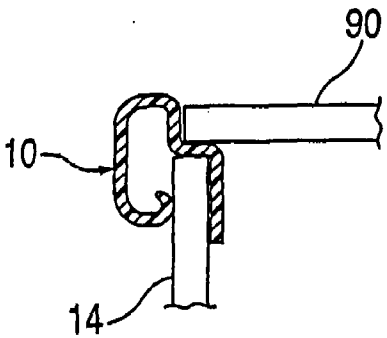
FIG. 4B is a partial side sectional view of the frame assembly shown in FIG. 4A further provided with a top plate.

In the embodiment of the invention shown in FIG. 4A, hinge connectors 70*a*, 70*b*, 70*c*, 70*d* replace four corner connectors 50, which would otherwise be used for framing each piece of poster board 14. Attachment 72 of each of hinge connectors 70*a*, 70*b*, 70*c*, 70*d* allows poster boards 14*a*, 14*b* to be set and fixed at an infinite number of angles relative to one another. In FIG. 4A, each framed poster board 14 is set at an angle to one another slightly greater than 90°, though any angle, such as an acute angle or a right angle, could have been set. Once set, segment 10*a*, which is analogous to segments 10 as illustrated in FIG. 3, is snapped into, and connects, one part of hinge connector 70*c* to an analogous portion of hinge connector 70*d* for fixing framed poster boards 14*a*, 14*b* relative to one another at a desired angle. This arrangement readily allows the framed poster boards in FIG. 4A to be displayed in an upright manner without other means of support. In addition, as shown in FIG. 4B, due to the fact that the frame sections 10 are provided with a step defined by flex point 12*b*, a recessed top plate 90 (preferably also made of posterboard) can be mounted on the step of frame sections 10*a* to cover the top opening.

Figure 8A:
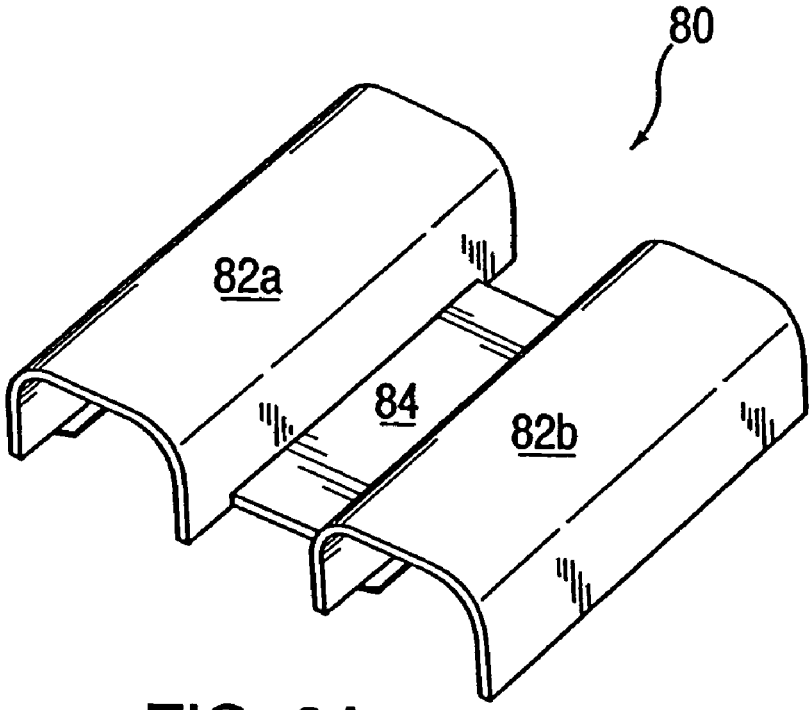
FIG. 8B is a side elevation view of an alternate embodiment of the joiner hinge.

FIG. 8 is a top perspective view of a joiner hinge 80, which is useful for joining the substantially E-shaped profile segments 10 of two pieces of poster board 14*a*, 14*b* framed with the snap-together poster board system of the present invention. Joiner hinge 80 is comprised of two segments 82*a*, 82*b*, each of which are analogous to a linear portion of corner connector 50, which is illustrated in FIGS. 3–5. Segments 82*a*, 82*b* of joiner hinge 80 are attached to one another via a flexible, durable web plastic material 84, which is, preferably, polypropylene. With joiner hinges 80, one is able to connect the frames of two poster boards 14*a*, 14*b*, along a portion of segment 10 of each frame, e.g., as such frames are arranged in FIG. 4A.

Figure 8B:
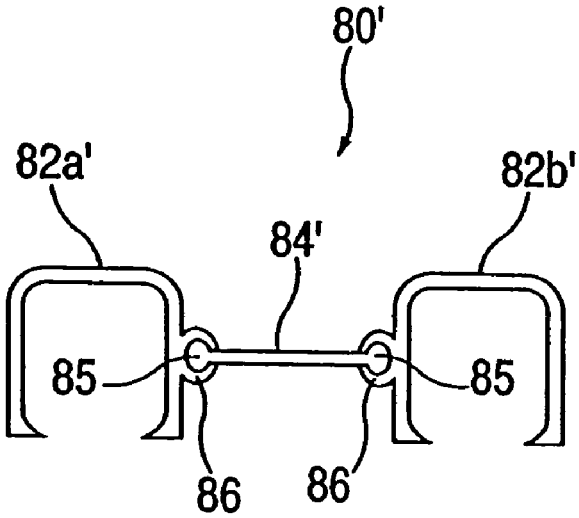

FIG. 8B shows an alternate embodiment of the joiner hinge 80' which is similar to the joiner hinge 80 except for the living hinge 84' being an insertable hinge having beads 85 on its ends which are slidably receivable in generally C-shaped channels provided on the inner sidewalls of segments 82*a'* and 82*b'*.

The various segments, corner connectors, end connectors and hinges are, collectively, designed to allow one to readily provide poster board, or any similar surface, with a frame of any size, which may be readily connected and fixedly set in relation to one or more other so-framed poster boards, with segments which have a novel shape which permits less of the surface of the poster board to be consumed, or covered, by the frame. The illustrations of the shapes of such segments, hinges, connectors, etc., are intended as being only exemplary of what is possible and what is within the scope of the intended invention. The possible shapes and arrangements, using the concepts disclosed herein, are virtually limitless.

It should also be realized that the living hinge connectors 50, 60, 70, 80 can possibly also be used with other frame systems, such as those disclosed in my earlier patents noted above. In addition, the frame corner connectors may be provided with mount accessories (not shown) to allow the poster frame to stand by itself (e.g., as a counter stand) or to be mounted on a wall (e.g., by hook attachments).

The various elements of the snap-together poster frame system of the present invention may be readily made by conventional injection molding techniques.

While only several embodiments of the present invention have been shown and described, it will be obvious to those skilled in the art that many modifications may be made to the present invention without departing from the spirit and scope thereof.

What is claimed is:

1. A snap-together poster frame, comprising:

a plurality of edge supports, each comprising a plurality of segments having a slotted, channel-shaped cross-sectional profile to define a single opening for receiving an edge of a poster board, said segments comprising a top wall, a bottom wall and a sidewall joining said top and bottom walls, said edge supports being resilient and said sidewall including a generally L-shaped instep by which it is joined to said bottom wall having three flex points which allows said opening to adjust to the width of the posterboard inserted therein, thereby retaining the edge of the poster board via an interference fit, said top wall and said bottom wall each having a front and rear end and said sidewall joining said rear ends of said front and bottom walls, said front ends defining an unobstructed mouth of said single opening between them and wherein said front end of said top wall and said bottom wall cooperate to resiliently grasp a poster board inserted therebetween, said sidewall comprising three generally linear segments, including a first segment, a second segment and a third segment, said first segment being disposed generally perpendicularly relative to said top wall and said first segment having a first end coupled to said rear end of said top wall and a second end coupled to a first end of said second segment and said third segment disposed generally perpendicularly to said second segment and said bottom wall, said third segment having a first end coupled to a second end of said second segment and a second end coupled to said rear end of said bottom wall.

2. The snap-together poster frame according to claim 1, wherein said profile of said plurality of segments includes a step which is defined at least in part by a leg of said L-shaped instep joined to said bottom wall.

3. The snap-together poster frame according to claim 1, wherein said plurality of segments are linear.

4. The snap-together poster frame according to claim 1, wherein said front end of said top wall includes an over-hang and said bottom wall is substantially flat.

5. The snap-together poster frame according to claim 1, further comprising at least one corner connector for connecting adjacent ends of said edge supports to one another.

6. The snap-together poster frame according to claim 5, wherein said at least one corner connector is made of a resilient material and having a shape of slightly greater dimension than said edge supports, said at least one corner connector having sufficient resiliency so that it is capable of snapping over and securely grabbing an adjacent end of two edge supports.

7. The snap-together poster frame according to claim 6, wherein said frame includes four segments of said edge supports and four of said corner at least one corner connector.

8. The snap-together poster frame according to claim 6, wherein said resilient material is a flexible plastic material.

9. A snap-together poster frame system comprising:

at least two snap-together poster frames each comprising a plurality of segments having a slotted, channel-shaped cross-sectional profile to define a single opening for receiving an edge of a poster board, said segments each comprising a top wall, a bottom wall and a sidewall joining said top wall and bottom wall, said segments being resilient and said sidewall including a generally L-shaped instep having three flex points which allows said opening to adjust to the width of the poster board inserted therein, thereby retaining the edge of the poster board via an interference fit, said system further comprising at least one end connector for connecting the ends of one of said snap-together poster frames to the ends of another of said snap-together poster frames, said top wall and said bottom wall each having a front and rear end and said sidewall joining said rear ends of said front and bottom walls, said front ends defining an unobstructed mouth of said single opening and wherein said front end of said top wall and said bottom wall cooperate to resiliently grasp a poster board inserted therebetween, said sidewall comprising three generally linear segments, including a first segment, a second segment and a third segment, said first segment being disposed generally perpendicularly relative to said top wall and said first segment having a first end coupled to said rear end of said top wall and a second end coupled to a first end of said second segment and said third segment disposed generally perpendicularly to said second segment and said bottom wall, said third segment having a first end coupled to a second end of said second segment and a second end coupled to said rear end of said bottom wall.

10. The snap-together poster frame system according to claim 9, wherein said at least one end connector is comprised of two linear segments in-line with one another, each of said linear segments being made of a resilient material and having a shape of slightly greater dimension than said edge supports, said linear segments each having sufficient resiliency so that each is capable of snapping over and securely grabbing an adjacent end of two edge supports, said at least one end connector further including a flexible attachment between said two linear segments.

11. The snap-together poster frame system according to claim 10, wherein said resilient material is a flexible plastic material.

* * * * *